US009975262B2

(12) United States Patent
Safar

(10) Patent No.: US 9,975,262 B2
(45) Date of Patent: May 22, 2018

(54) FINGERTIP MOUNTABLE SHAVING DEVICE

(71) Applicant: Samir Hanna Safar, San Diego, CA (US)

(72) Inventor: Samir Hanna Safar, San Diego, CA (US)

(73) Assignee: Samir Hanna Safar, San Diego, CA (US)

( * ) Notice: Subject to any disclaimer, the term of this patent is extended or adjusted under 35 U.S.C. 154(b) by 138 days.

(21) Appl. No.: 15/075,167

(22) Filed: Mar. 20, 2016

(65) Prior Publication Data

US 2016/0236366 A1 Aug. 18, 2016

Related U.S. Application Data

(63) Continuation-in-part of application No. 14/622,880, filed on Feb. 15, 2015, now Pat. No. 9,738,001.

(51) Int. Cl.

| | |
|---|---|
| ***B26B 21/52*** | (2006.01) |
| ***B26B 19/14*** | (2006.01) |
| ***B26B 21/06*** | (2006.01) |
| ***B26B 21/40*** | (2006.01) |

(52) U.S. Cl.

CPC ..... *B26B 21/527* (2013.01); *B26B 21/4025* (2013.01); *B26B 19/148* (2013.01); *B26B 21/06* (2013.01)

(58) Field of Classification Search

CPC ..... B26B 21/527; B26B 21/22; B26B 21/225; B26B 21/227; B26B 21/28; B26B 21/4043; B26B 21/52; B26B 21/54; B26B 21/56; B26B 21/4006; B26B 21/02; B26B 21/04; B26B 21/06; B26B 19/148

USPC ..... 30/50, 298, 346.55, 346.57, 346.58, 30/346.59, 346.61, 29.5, 34.05, 34.1, 232, 30/198; D28/45, 46, 47

See application file for complete search history.

(56) References Cited

U.S. PATENT DOCUMENTS

| | | | | |
|---|---|---|---|---|
| 3,314,146 A * | 4/1967 | Cooksey | B26B 19/00 | 30/34.05 |
| 5,343,622 A * | 9/1994 | Andrews | B26B 21/00 | 30/50 |
| 5,802,720 A * | 9/1998 | Pribe | B26B 21/00 | 30/32 |
| 6,018,877 A * | 2/2000 | Greene | B26B 21/222 | 30/298 |

(Continued)

*Primary Examiner* — Stephen Choi
*Assistant Examiner* — Evan MacFarlane
(74) *Attorney, Agent, or Firm* — Samir Hanna Safar

(57) ABSTRACT

A fingertip mountable shaving device for shaving hair includes a base unit, a shaving unit, an enclosing unit and a top unit. The shaving unit has a plurality of blade assemblies and a plurality of elastomeric inserts. Each blade assembly further includes a plurality of uniformly spaced, equally high and parallel blade members, tilted at a predetermined angle, such that the plurality of blade assemblies intersect in a criss-cross patterned grid. Elastomeric inserts provided on each peripheral side of the blade assembly, support the corresponding blade assembly in place to maintain the predetermined angle. The device provides multiple blades and allows safe and close shaving particularly from difficult to access body parts by relying on the sense of feel rather than visibility of the surface to be shaved, and is easy to manufacture.

8 Claims, 8 Drawing Sheets

(56) References Cited

U.S. PATENT DOCUMENTS

| | | | | |
|---|---|---|---|---|
| 6,029,356 | A * | 2/2000 | Sprinkle | B26B 21/08 30/298 |
| 6,505,403 | B1 * | 1/2003 | Andrews | B26B 21/00 30/29.5 |
| 6,519,856 | B1 * | 2/2003 | Dischler | B26B 21/22 30/346.57 |
| 8,141,258 | B1 * | 3/2012 | Frisch | B26B 21/527 30/298 |
| 8,991,060 | B2 * | 3/2015 | Safar | B26B 21/527 30/298 |
| 9,738,001 | B2 * | 8/2017 | Safar | B26B 21/527 |
| 2002/0050065 | A1 * | 5/2002 | Kludjian | B26B 21/22 30/50 |
| 2003/0033717 | A1 * | 2/2003 | Cecil | B26B 21/22 30/50 |
| 2003/0182802 | A1 * | 10/2003 | Vega | B26B 21/22 30/50 |
| 2006/0032060 | A1 * | 2/2006 | Nicolosi | A45D 26/0004 30/346.53 |
| 2007/0056404 | A1 * | 3/2007 | Pricone | B26B 21/225 76/25.1 |
| 2009/0113715 | A1 * | 5/2009 | Goss-Melendez | B26B 21/52 30/50 |
| 2011/0113631 | A1 * | 5/2011 | Zdunek | A45D 27/00 30/34.05 |
| 2014/0123497 | A1 * | 5/2014 | Zhuk | B26B 21/22 30/49 |
| 2015/0367522 | A1 * | 12/2015 | Martin | B26B 21/527 132/200 |

* cited by examiner

FINGERTIP MOUNTABLE SHAVING DEVICE

CROSS-REFERENCE TO RELATED APPLICATIONS

The present application is a continuation-in-part application of currently pending U.S. patent application Ser. No. 14/622,880, filed on Feb. 15, 2015, by the same inventor cum applicant, which is a continuation-in-part of issued U.S. Pat. No. 8,991,060; the entire content of each patent application and issued patent hereby incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

The present invention generally relates to a hair shaving device, more specifically to a fingertip mountable and manually operated shaving device. The invention aims to provide a flexible and disposable hair shaving device, which is easy to manufacture, suitable for single use that provides multiple blades and allows safe and close shaving particularly from difficult to access body parts by relying on the sense of feel rather than visibility of the surface to be shaved.

Background Art

Generally, razors are used for the removal of hair from skin and employ a plurality of individual blades, wherein each blade has a single longitudinally sharpened edge. However, these blades have a tendency to cut the user's skin and to otherwise cause discomfort during a shaving operation. In an effort to minimize the danger resulting from the exposed cutting edges of these blades, guards have been incorporated into the razor design. The guard generally includes a blunt, often rounded, edge projecting past the cutting edges of the razor blades. In addition to the tendency for the aforementioned razors to cut a user's skin during a shaving operation, the blades pose a handling problem during razor manufacture. The longitudinal cutting edges require careful and often time consuming, handling as well as a significant amount of processing to achieve the desired edge.

Further, apart from above-mentioned razors various finger mountable shaving devices used to shave hair from difficult to access body parts such as nostrils or ears are known in prior art. These devices range from manually operated to battery powered devices and may or may not be disposable. Many of these devices are bulky and are not easy to carry or use inside the nose, ears or on wrinkled skin surface.

U.S. Pat. No. 6,029,356, issued on Feb. 29, 2000, titled, "FINGER PAD SENSOR RAZOR", discloses a razor mounted on full or partial rings which slide all the way over the fingers to their proximal ends to be used as sensory feed-back means of hair stubble condition. This device is not suitable for shaving intricate body surfaces such as those inside the nose or ears.

U.S. Pat. No. 6,505,403, issued on Jan. 14, 2003, titled, "HAIR SHAVING DEVICE WITH U-SHAPED RAZOR BLADE STRIP", provides a manually manipulatable non electric hair trimming device, which is neither flexible nor disposable.

In the co-pending patent application, U.S. Patent Application Ser. No. 14/622,880, as well as in issued patent no. U.S. Pat. No. 8,991,060, the present inventor disclosed fingertip mountable shaving devices, that overcame the limitations of prior art, but posed certain challenges in manufacturing. The invention presently disclosed in this application provides improvement in shaving performance, enhanced features for safety against accidental cutting of the skin, while greatly improving the ease of manufacturing of the fingertip mountable shaving device.

None of the previously described prior art references provide a shaving device that is capable of being mounted on a fingertip and is flexible, disposable, small, light in weight, easy to operate, ease to manufacture commercially, non-electric, facilitates shaving by feel, and also provides a safe and close shaving finish while accessing intricate body parts. The present invention satisfies the present and other needs.

Further limitations and disadvantages of conventional and traditional approaches will become apparent to one of skill in the art, through comparison of described systems with some aspects of the present disclosure, as set forth in the remainder of the present application and with reference to the drawings.

BRIEF SUMMARY OF THE INVENTION

A fingertip mountable body hair shaving device for shaving hair from a body of a user is provided substantially as shown in, and/or described in connection with, at least one of the figures, as set forth more completely in the claims.

According to embodiments illustrated herein, there is provided a fingertip mountable body hair shaving device. The shaving device includes: (a) a base unit having a top surface and a bottom surface, (b) a shaving unit comprising a plurality of blade assemblies and a plurality of elastomeric inserts, (c) an enclosing unit and (d) a top unit.

The bottom surface of the base unit is coated with an adhesive and covered with a releasably connected protective peel off layer. The bottom surface being present on the opposite side of the top surface across a transversal axis.

The shaving unit comprises a plurality of blade assemblies and a plurality of elastomeric inserts. Each blade assembly further comprises a plurality of uniformly spaced, equally high and parallel blade members, tilted at a predetermined angle, such that the plurality of blade assemblies intersect in a criss-cross patterned grid. A plurality of elastomeric inserts is provided on each peripheral side of a blade assembly, so as to support the corresponding blade assembly in place to maintain the predetermined angle.

Each blade member is characterized by a cutting edge and a grooved edge. The grooved edge comprises a plurality of grooves to receive other blades, a plurality of holes. An elastomeric layer is coated or non-removably attached to the front surface of the blade as well as a part of its top surface, thereby forming a protective lip along the cutting edge of the blade. Engaging members provided in the elastomeric layer are inserted through the corresponding holes of the blade member for accurate alignment.

The shaving unit is non-removably coupled to the base unit through a plurality of slots. The enclosing unit further comprises a plurality of supporting members with means to engage with the base unit and enclose the shaving unit. The top unit comprises a plurality of elastomeric strips running along a vertical peripheral edge and configured to engage with the enclosing unit, such that the top unit is non-removably coupled to the enclosing unit.

The primary object of the present invention is to provide a shaving device that can safely and closely shave areas that are difficult to see and access such as, within the ear, nostrils, back of the neck.

A further object is to provide a shaving device that is easy to assemble and manufacture. Another object of the present invention is to provide a shaving device that facilitates shaving by feel and does not require a visual aid such as a mirror while shaving. A further object of the present invention is to provide a shaving device that is flexible and easily conforms to the contours of the skin surface to be shaved as well as the fingertip.

A still further object of the present invention is to provide a shaving device that is small in size, light in weight, easy to carry and comfortable to use. Yet another object of the present invention is to provide a shaving device that is disposable and suitable for single use. Yet further object of the present invention is to provide a shaving device that is not powered by any electrical source and can be conveniently operated manually. Yet another object of the present invention is to provide a shaving device that allows shaving in multiple directions, without risking any cuts to the skin of the user. Still another object of the present invention is to provide a shaving device that is self adhesive in nature and does not require additional effort on part of the user to specifically hold in place by the user.

These and other objects of the present invention are further elaborated in the detailed description of the invention. These objects should be construed to be merely illustrative of some of the more prominent features and applications of the invention and not as to limit the scope of the invention. Applying or modifying the disclosed invention in a different manner can attain many other beneficial results or modifying the invention as will be described. Accordingly, referring to the following drawings may have a complete understanding of the invention. Description of the preferred embodiment is as follows.

BRIEF DESCRIPTION OF THE SEVERAL VIEWS OF THE DRAWINGS

The accompanying drawings illustrate the various embodiments of systems, methods, and other aspects of the disclosure. Any person with ordinary skill in the art will appreciate that the illustrated element boundaries (e.g., boxes, groups of boxes, or other shapes) in the figures represent one example of the boundaries. In some examples, one element may be designed as multiple elements, or multiple elements may be designed as one element. In some examples, an element shown as an internal component of one element may be implemented as an external component in another, and vice versa. Further, the elements may not be drawn to scale.

Various embodiments will hereinafter be described in accordance with the appended drawings, which are provided to illustrate and not to limit the scope in any manner, wherein similar designations denote similar elements, and in which.

LIST OF REFERENCE NUMBERING

Figure 1:
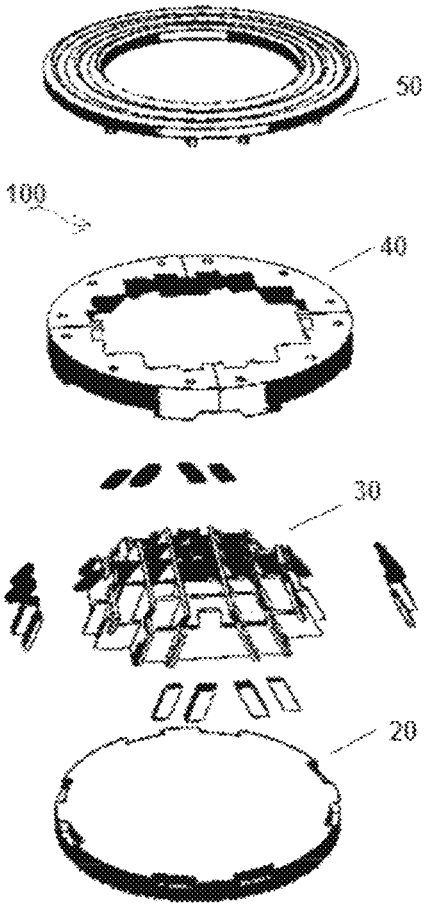
FIG. 1 illustrates an exploded view of the fingertip mountable shaving device, in accordance with at least one embodiment.

10 labels a protective peel off layer
20 labels a base unit
21 labels a slot in the base unit
22 labels a top surface of the base unit
23 labels a bottom surface of base unit
30 labels a shaving unit
31 labels a plurality of blade assemblies
32 labels a blade member
33 labels a grooved edge of the blade member
34 labels a cutting edge of the blade member
35 labels a hole in the blade member
36 labels an elastomeric insert
37 labels an elastomeric layer attached to the blade member
38 labels a protective lip
39 labels a elastomeric layer alignment member
40 labels an enclosing unit
42 labels a supporting member of the enclosing unit
50 labels a top unit
51 labels a plurality of elastomeric strips running along a vertical peripheral edge of the top unit
100 labels a fingertip mountable shaving device
40A labels engaging members of the enclosing unit

DETAILED DESCRIPTION OF THE INVENTION

The present disclosure is best understood with reference to the detailed figures and description set forth herein. Various embodiments are discussed below with reference to the figures. However, those skilled in the art will readily appreciate that the detailed descriptions given herein with respect to the figures are simply for explanatory purposes as the methods and systems may extend beyond the described embodiments. For example, the teachings presented and the needs of a particular application may yield multiple alternative and suitable approaches to implement the functionality of any detail described herein. Therefore, any approach may extend beyond the particular implementation choices in the following embodiments described and shown.

References to "one embodiment," "at least one embodiment," "an embodiment," "one example," "an example," "for example," and so on indicate that the embodiment(s) or example(s) may include a particular feature, structure, characteristic, property, element, or limitation but that not every embodiment or example necessarily includes that particular feature, structure, characteristic, property, element, or limitation. Further, repeated use of the phrase "in an embodiment" does not necessarily refer to the same embodiment.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, the preferred methods and materials are now described. All publications, patents and patent applications mentioned herein are incorporated herein in their entirety.

It is also noted that as used herein and in the appended claims, the singular forms "a", "and", and "the" include plural referents unless the context clearly dictates otherwise. In the claims, the terms "first," "second", and so forth are to be interpreted merely as ordinal designations they shall not be limited in themselves. Further, the use of exclusive terminology such as "solely," "only" and the like in connection with the recitation of any claim element is contemplated. Also, it is contemplated that any element indicated to be optional herein may be specifically excluded from a given claim by way of a "negative" limitation. Finally, it is contemplated that any optional feature of the inventive variation(s) described herein may be set forth and claimed independently or in combination with any one or more of the features described herein.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and plural, unless indicated herein or clearly contradicted by context. The terms "comprising", "having", "including", and "containing" are to be construed as open-ended terms (i.e., meaning "including, but not limited to,") unless otherwise noted. The term "connected" is to be construed as partly or wholly contained within, attached to, or joined together, even if there is something intervening.

The recitation of ranges of values herein are merely intended to serve as a shorthand method of referring individually to each separate value failing within the range, unless otherwise indicated herein, and each separate value is incorporated into the specification as if it were individually recited herein.

Figure 9:
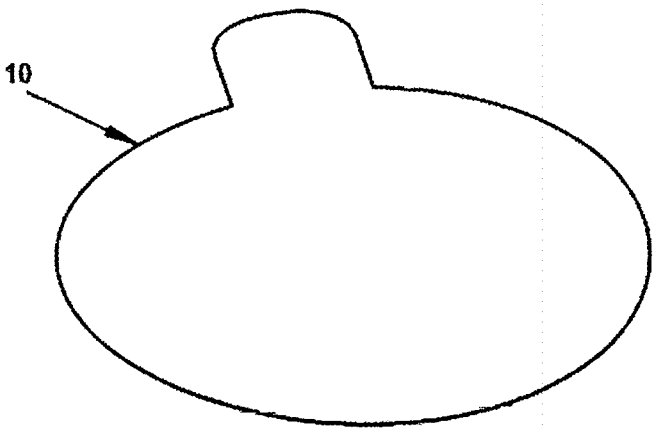
FIG. 9 illustrates a protective peel off layer, in accordance with at least one embodiment.

FIG. 1 illustrates an exploded view of a fingertip mountable shaving device 100 for shaving hair from a body of a user, in accordance with at least one embodiment. The fingertip mountable shaving device 100 includes a base unit 20, a shaving unit 30, an enclosing unit 40, and a top unit 50, and a protective peel off layer 10 (shown and explained in conjunction with FIG. 9).

Figure 2:
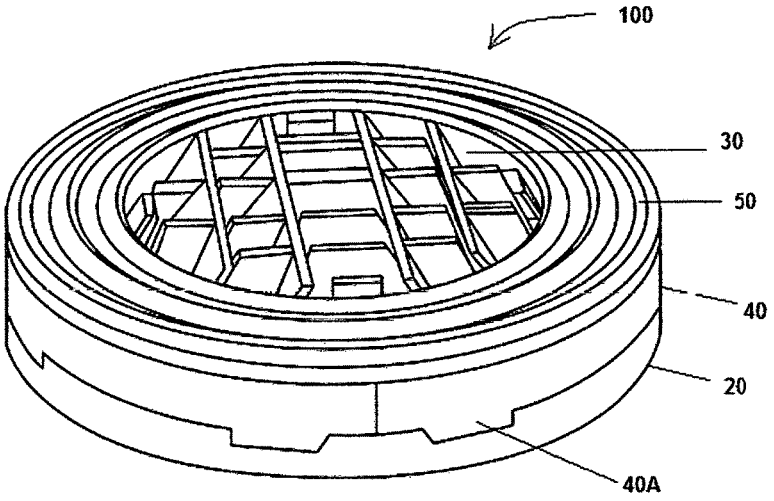
FIG. 2 illustrates an assembled view of the fingertip mountable shaving device, in accordance with at least one embodiment.

FIG. 2 illustrates an assembled view of the fingertip mountable shaving device 100 for shaving hair from a body of a user, in accordance with at least one embodiment. The fingertip mountable shaving device 100 includes a base unit 20, a shaving unit 30, an enclosing unit 40, and a top unit 50, and a protective peel off layer 10 (shown and explained in conjunction with FIG. 9).

Figure 3:
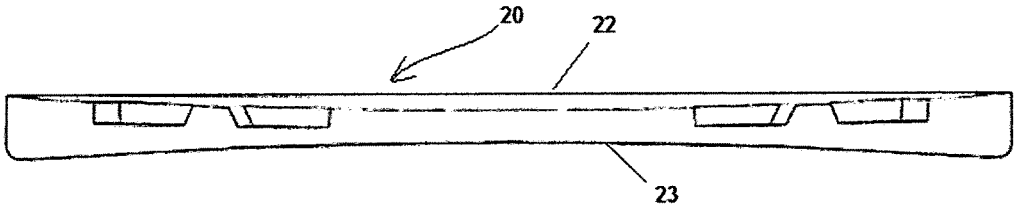
FIG. 3 illustrates side view of the base unit, in accordance with at least one embodiment.
Figure 4:
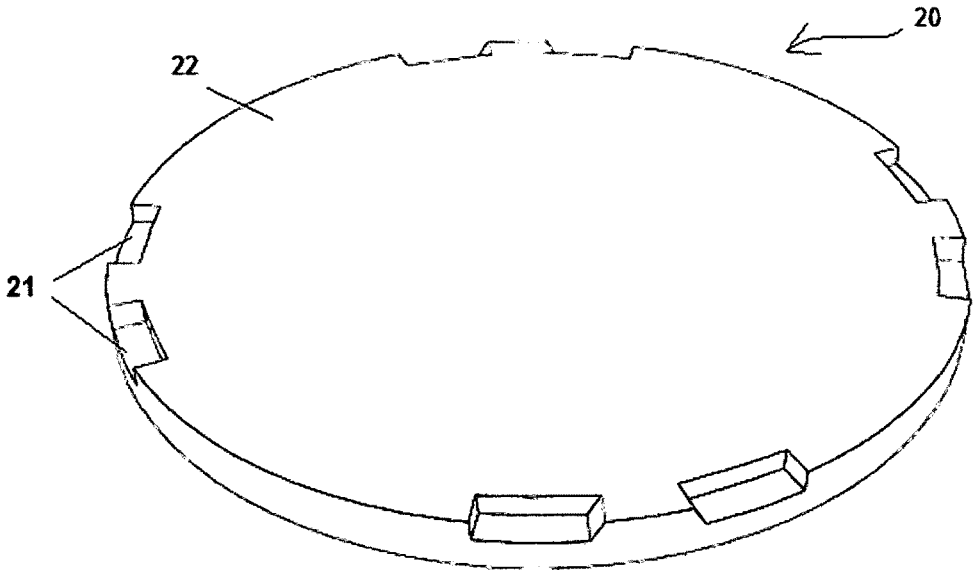
FIG. 4 illustrates an isometric view of the base unit, in accordance with at least one embodiment.

As depicted in FIG. 3 and FIG. 4, the base unit 20 has a top surface 22 and a bottom surface 23. The base unit 20 is provided with a plurality of slots on the top surface 22. The base unit 20 is of curved shape in order to fit on to the fingertip of a user. The bottom surface is coated with an adhesive and covered with a releasably connected protective peel off layer 10 (shown and explained in conjunction with FIG. 9).

Figure 5:
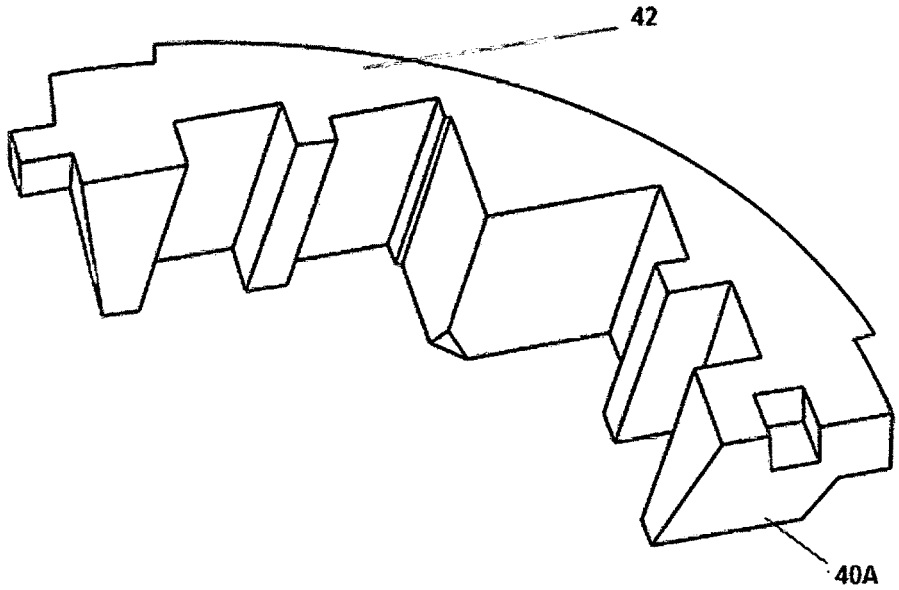
FIG. 5 illustrates a top isometric view of a supporting member of the enclosing unit, in accordance with at least one embodiment.
Figure 12:
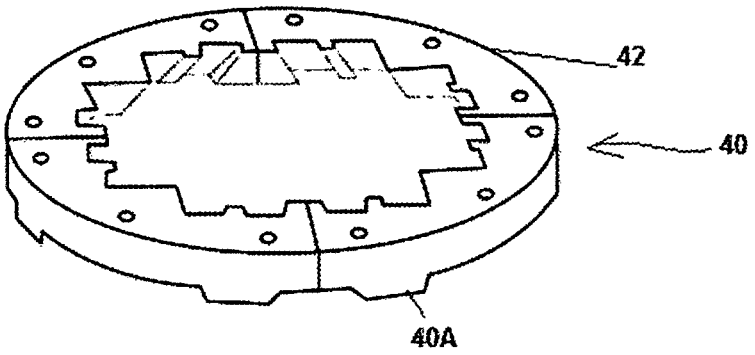
FIG. 12 illustrates the enclosing unit, in accordance with at least one embodiment.

FIG. 5 represents a supporting member of the enclosing unit 40, denoted by the reference numeral 42. A plurality of such supporting members 42 comprise of the enclosing unit 40 (as depicted in FIG. 12). The enclosing unit 40 is provided with corresponding engaging members 40A so as to be non-removably coupled to the plurality of slots 21. Enclosed within the enclosing unit 40, is the shaving unit 30.

Figure 7:
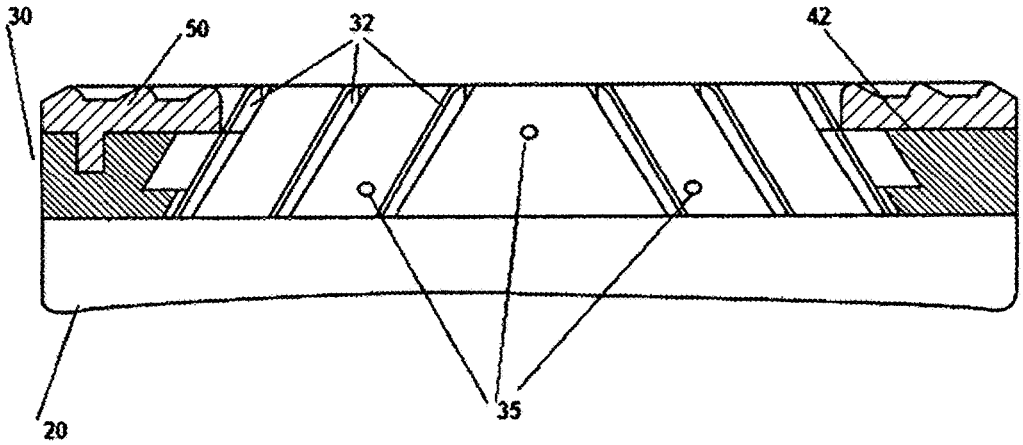
FIG. 7 illustrates an exemplary, partial, side cross sectional view of the shaving unit along with the base unit and the enclosing unit, in accordance with at least one embodiment.
Figure 10:
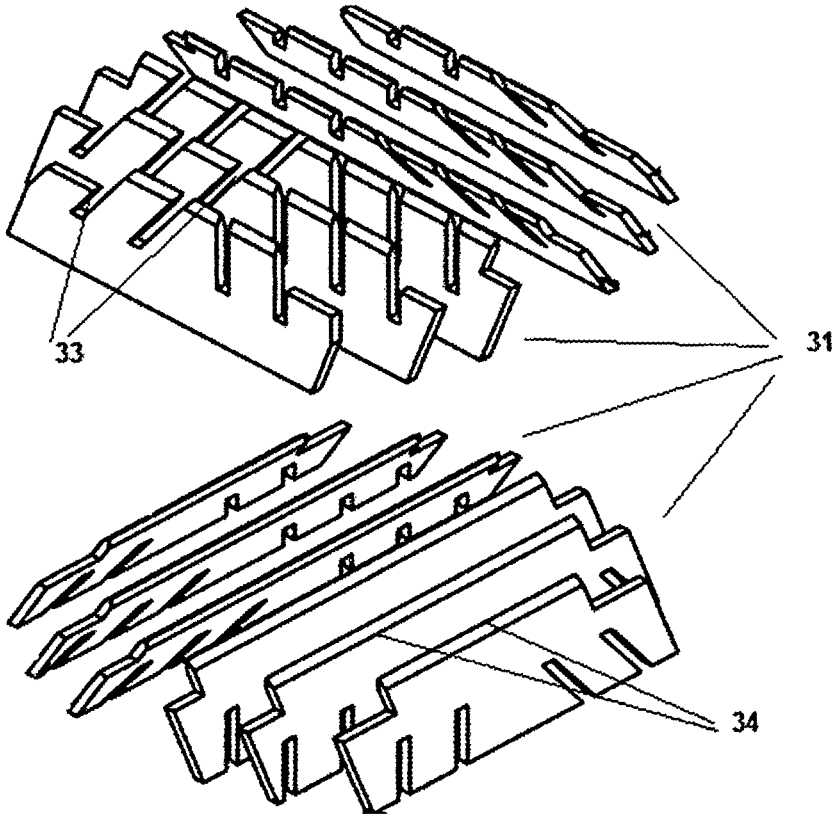
FIG. 10 illustrates a plurality of blade assemblies, in accordance with at least one embodiment.

The shaving unit 30 is provided within the boundary of the enclosing unit 40 and is non-removably coupled to the top surface 22 of the base unit 20. The shaving unit 30 comprises of a plurality of blade assemblies 31 and a plurality of elastomeric inserts 36. Each blade assembly further comprises of a plurality of uniformly spaced, equally high and parallel blade members 32, tilted at a predetermined angle, such that the plurality of blade assemblies intersect in a criss-cross patterned grid (as shown in, FIG. 7, and FIG. 10). Each singularity of blade 32 is provided with a plurality of grooves to receive other blades, and also has a plurality of holes 35. Each blade member 32 is characterized by a grooved edge 33 and a cutting edge 34.

Figure 6:
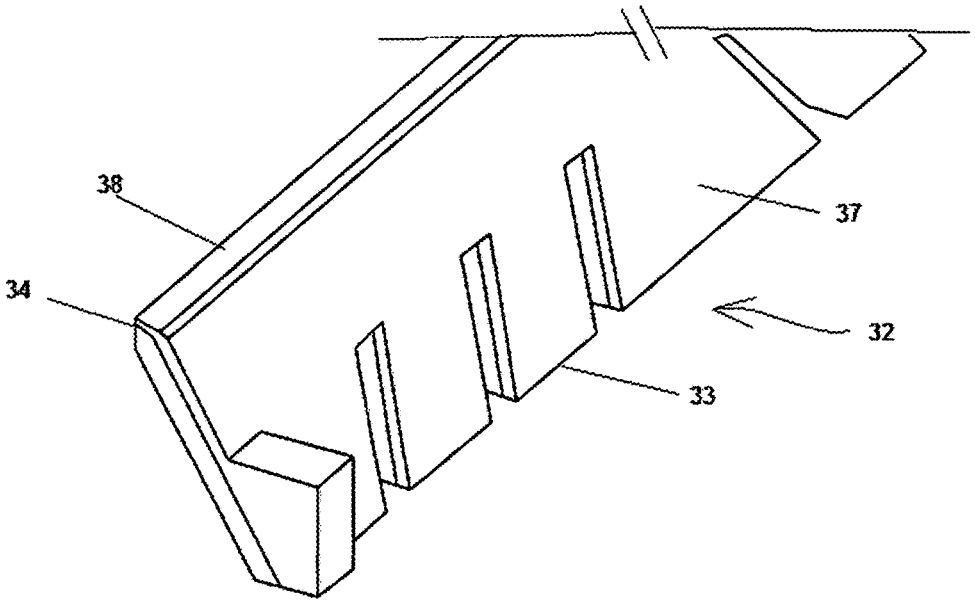
FIG. 6 illustrates an exemplary view of the arrangement of a blade member and the elastomeric layer, in accordance with at least one embodiment.
Figure 8:
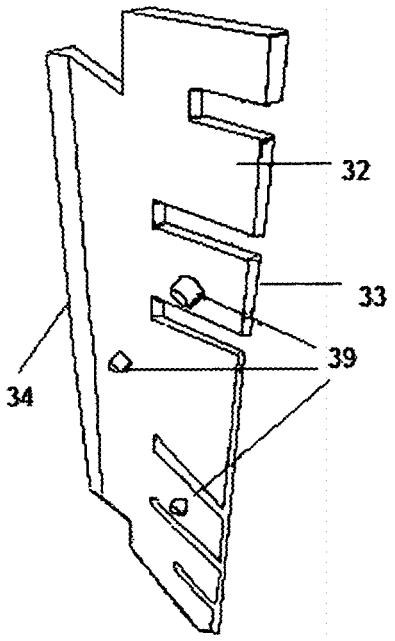
FIG. 8 illustrates an exemplary perspective view of a blade member, in accordance with at least one embodiment.

Each blade member 32 is further characterized by an elastomeric protective layer 37, non-removably attached to its one surface by means of an elastomeric layer aligning member 39 being inserted through the aligning holes 35 of the blade member 32 so as to provide a protective lip 38 of the elastomeric material along the cutting edge 34. (as shown and depicted in FIG. 6, FIG. 8 and FIG. 13). In alternate embodiments, the elastomeric layer 37 may be directly coated on the blade member 32.

The protective lip 38 prevents accidental cutting of the skin. Since the blade assemblies form a crisscross pattern, when the motion of shaving is in the X-direction, the blades in the Y-direction are covered by the protective lip 38 so as to prevent slicing the skin, and vice versa when the motion is in the Y-directions, the protective lip cover the sharp edge of the blade members in the X-direction.

Figure 13:
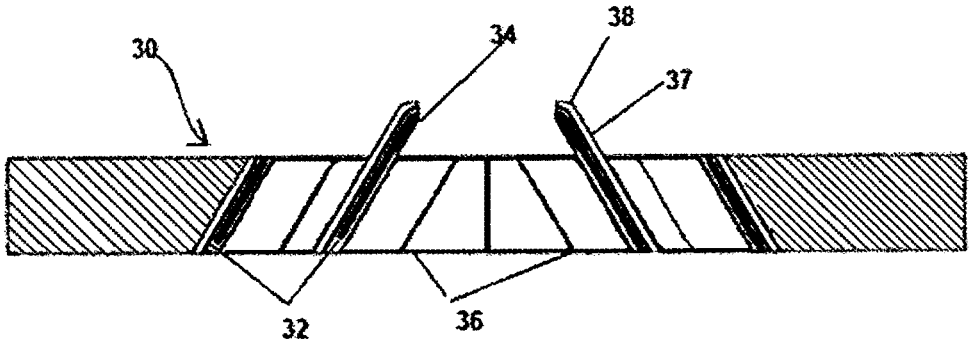
FIG. 13 illustrates the side cross-sectional view of the shaving unit, in accordance with at least one embodiment.
Figure 15:
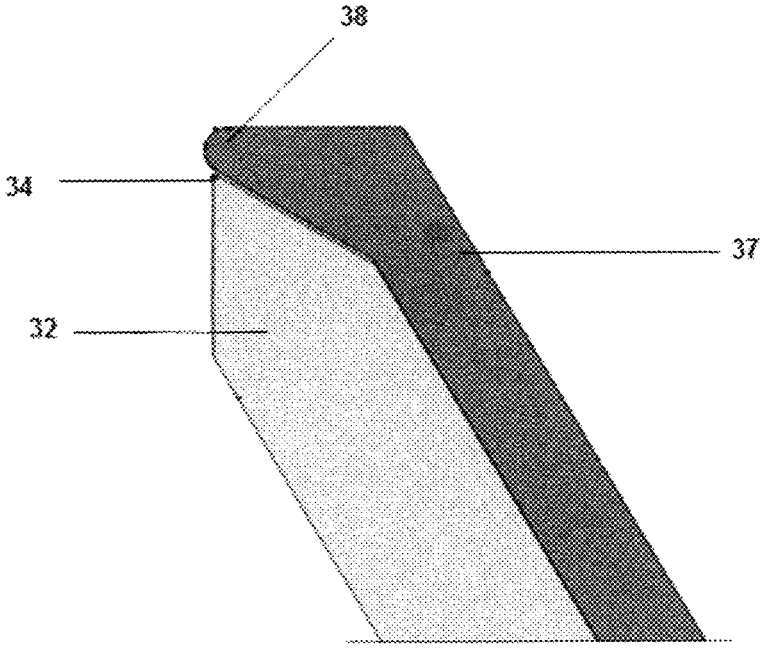
FIG. 15 illustrates an enlarged view of a blade member, in accordance with at least one embodiment.

The plurality of elastomeric inserts 36 provided on each peripheral side of a blade assembly 31 is to give support to the corresponding blade assembly to maintain the predetermined angle (as shown and explained in FIG. 13 and FIG 15).

FIG. 15 depicts an enlarged view of a blade member 32 having a cutting edge 34. The elastomeric layer 37 is non-removably attached to the blade member 32 to form a protective lip 38.

In a preferred embodiment of the invention, the plurality of blade members 32 and accordingly the corresponding blade assemblies 31 are tilted at a predetermined angle, such that the predetermined angle is in the range of 35 to 60 degrees from the horizontal. In a more preferred embodiment of the invention, the predetermined angle is in the range of 40 to 45 degrees from the horizontal.

Figure 11:
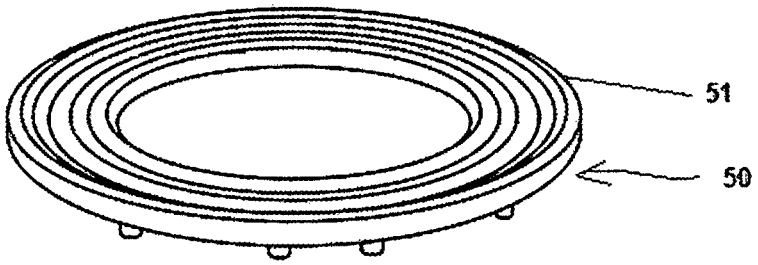
FIG. 11 illustrates the top unit, in accordance with at least one embodiment.

FIG. 11 depicts the top unit 50 comprising a plurality of elastomeric strips 51 running along a vertical peripheral edge and configured to engage with the enclosing unit 40.

Figure 14:
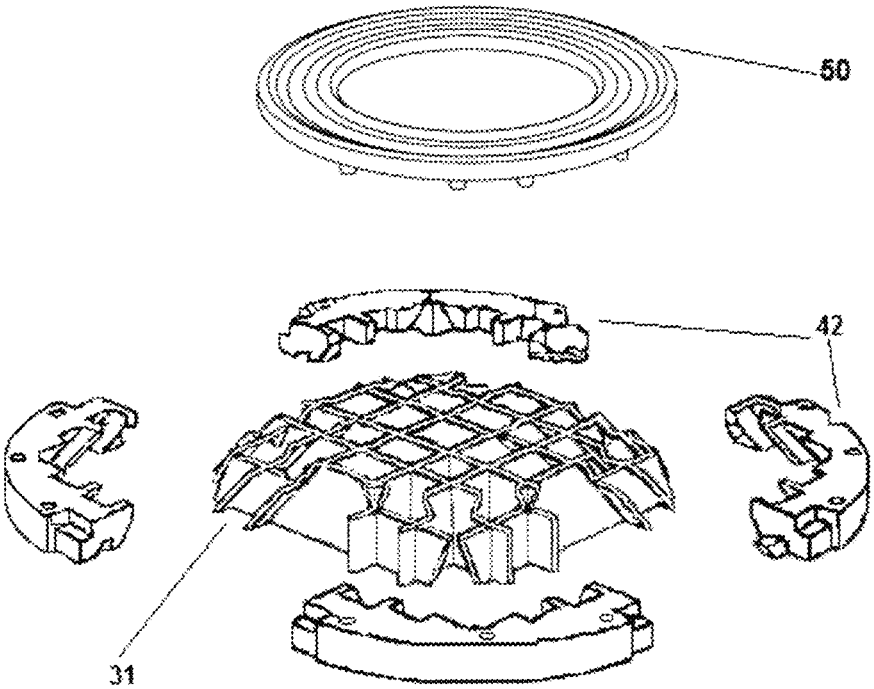
FIG. 14 illustrates an exploded view of the top unit, the enclosing unit, and the shaving unit, in accordance with at least one embodiment.

FIG. 14 illustrates an alternate exploded view of a fingertip mountable shaving device 100 for shaving hair from a body of a user, in accordance with at least one embodiment, depicting a plurality of blade assemblies 31 in an assembled view, supporting members of an enclosing unit 42 in exploded view, and a top unit 50.

The Applicant believes that the above amendments to the specification do not introduce any new matter and will add to the conciseness and clarity of the description of the invention.

In accordance with the present invention, the fingertip mountable hair shaving device 100, comprises (a) a base unit having a top surface and a bottom surface, the bottom surface coated with an adhesive and covered with a releasably connected protective peel off layer, and the bottom surface being on the opposite side of the top surface across a transversal axis;

(b) a shaving unit further comprising:

a plurality of blade assemblies, each blade assembly comprising a plurality of uniformly spaced, equally high and parallel blade members, tilted at a predetermined angle, such that the plurality of blade assemblies intersect in a criss-cross patterned grid, and each singularity of blade having a cutting edge and a grooved edge, the grooved edge comprising a plurality of grooves to receive other blades, a plurality of holes, and being characterized by an elastomeric protective layer non-removably attached to one surface of the singularity of blade by means of an engaging member inserted through the aligning holes of the blade so as to provide a lip of the elastomeric material along the cutting edge of the blade, a plurality of elastomeric inserts on each peripheral side of a blade assembly to provide support to the corresponding blade assembly to maintain the predetermined angle, (c) an enclosing unit further comprising a plurality of supporting members with means to engage with the base unit and enclose the shaving unit;

(a) a top unit comprising of a plurality of elastomeric strips running along a vertical peripheral edge and configured to engage with the enclosing unit; wherein the top unit is non-removably coupled to the enclosing unit and the shaving unit is non-removably coupled to the top surface of the base unit.

In accordance with at least one embodiment, the shaving device 100 is of substantially circular in shape. It will be readily known to those skilled in the art that various other shapes such as elliptical, oval or any other geometric pattern may also be used for the shaving device 100 without deviating from the scope of the present invention.

In accordance with at least one embodiment, the overall diameter of the shaving device 100 has a value in the range of 10 to 25 millimeter and preferably 14 to 20 mm. The overall thickness of the shaving device 100 has a value in the range of 3 to 6 millimeters and preferably 3 to 4 millimeters.

The elastomeric material layer 37, the elastomeric inserts 36 and the plurality of vertical peripheral strips of the top unit 51 may be made of a material selected from a group consisting of latex based, non-latex based, natural and synthetic fibers.

In an embodiment of the present invention, the distance between two consecutive blade members is in the range of 1.1 to 2 millimeter.

In an embodiment of the present invention, the plurality of blade assemblies may be in the range of three to six. In a preferred embodiment, the plurality of blade assemblies is four. It will be appreciated by one skilled in the art that any number of plurality of blade assemblies may also be used without deviating from the scope of the present invention.

A blade assembly 31 includes blade members of various lengths. Typically, the blade member in the center is the longest amongst all other blade members. In an embodiment of the invention, the number of blade members in an assembly may range from three to six. It will be appreciated by one skilled in the art that any number of blade members can constitute a blade assembly, without deviating from the scope of the present invention.

Thus the present system provides a shaving device that is capable of being mounted on a fingertip and is flexible, disposable, small, light in weight, easy to operate, non-electric, facilitates shaving by feel, and also provides a safe and close saving finish while accessing intricate body parts.

No language in the specification should be construed as indicating any non-claimed element as essential to the practice of the invention.

It will be apparent to those skilled in the art that various modification and variations can be made to the present invention without departing from the spirit and scope of the invention. There is no intention to limit the invention to the specific form or forms enclosed, but on the contrary, the intention is to cover all modification, alternative construction, and equivalents falling within the spirit and scope of the invention, as defined in the appended claims. Thus, it is intended that the present invention cover the modification and variation of this invention provided they come within the scope of the appended claims and their equivalents.

The invention claimed is:

1. A fingertip mountable shaving device comprising:

(a) a base unit having a top surface and a bottom surface, the bottom surface coated with an adhesive and covered with a releasably connected protective peel off layer, and the bottom surface being on the opposite side of the top surface across a transversal axis;

(b) a shaving unit further comprising:

a plurality of blade assemblies, each blade assembly comprising a plurality of uniformly spaced, equal in height relative to the top surface and parallel blade members, wherein each blade member is tilted at a same predetermined angle as others of the blade members of the same blade assembly, such that the plurality of blade assemblies intersect in a criss-cross patterned grid, and each singularity of the blade members having a grooved edge, the grooved edge comprising a plurality of grooves to receive others of the blade members, a plurality of aligning holes, and being characterized by an elastomeric protective layer attached to one surface of the singularity of blade so as to provide a lip of the elastomeric protective layer along a cutting edge of the blade, and the elastomeric protective layer is provided with at least one engaging member for insertion through one of the aligning holes of the blade member for accurate alignment, a plurality of elastomeric inserts on each peripheral side of each of the blade assemblies to provide support to the corresponding blade assembly to maintain the predetermined angle, (c) an enclosing unit further comprising a plurality of supporting members with means to engage with the base unit and enclose the shaving unit;

(d) a top unit comprising of a plurality of elastomeric strips running along a vertical peripheral edge and the top unit configured to engage with the enclosing unit;

wherein the top unit is fixedly coupled to the enclosing unit and the shaving unit is fixedly coupled to the top surface of the base unit.

2. The fingertip mountable shaving device according to claim 1, wherein the shaving device is substantially circular in shape.

3. The fingertip mountable shaving device according to any of the claims 1 to 2, wherein the overall diameter of the shaving device has a value in the range of 10 to 25 millimeters.

4. The fingertip mountable shaving device according to any of the claims 1 to 2, wherein the overall diameter of the shaving device has a value in the range of 14 to 20 millimeters.

5. The fingertip mountable shaving device according to any of the claims 1 to 2, wherein the overall thickness of the shaving device has a value in the range of 3 to 6 millimeters.

6. The fingertip mountable shaving device according to any of the claims 1 to 2, wherein the predetermined angle is in the range of 35 to 60 degrees relative to the top surface of the base unit.

7. The fingertip mountable shaving device according to any of the claims 1 to 2, wherein the distance between two consecutive of the blade members is in the range of 1.1 to 2 millimeters.

8. The fingertip mountable shaving device according to any of the claims 1 to 2, wherein the plurality of blade assemblies is in the range of three to six.

* * * * *